US007340075B2

(12) United States Patent
Bayer

(10) Patent No.: US 7,340,075 B2
(45) Date of Patent: Mar. 4, 2008

(54) OTOPLASTY FOR BEHIND-THE-EAR (BTE) HEARING AIDS

(76) Inventor: Erich Bayer, Gerhart-Hauptmann-Strasse 13, Straubing (DE) 94315

( * ) Notice: Subject to any disclaimer, the term of this patent is extended or adjusted under 35 U.S.C. 154(b) by 391 days.

(21) Appl. No.: 10/960,748

(22) Filed: Oct. 8, 2004

(65) Prior Publication Data

US 2005/0111686 A1 May 26, 2005

Related U.S. Application Data

(63) Continuation of application No. 10/030,192, filed as application No. PCT/EP01/02656 on Mar. 9, 2001, now abandoned.

(30) Foreign Application Priority Data

Jun. 2, 2000 (DE) ..... 200 09 908 U

(51) Int. Cl.
*H04R 25/00* (2006.01)

(52) U.S. Cl. ..... 381/330; 381/328

(58) Field of Classification Search ..... 381/322, 381/324, 327–328, 330, 380–382
See application file for complete search history.

(56) References Cited

U.S. PATENT DOCUMENTS 1,668,910 A * 5/1928 Jones ..... 381/380
2,763,334 A * 9/1956 Starkey ..... 181/135
2,939,923 A 6/1960 Henderson
6,094,492 A * 7/2000 Boesen ..... 381/326
2004/0165743 A1 8/2004 Bayer

FOREIGN PATENT DOCUMENTS

| | | |
|---|---|---|
| DE | 38 26 897 | 3/1989 |
| DE | 297 18 483 | 4/1999 |
| EP | 0 836 364 | 4/1998 |
| JP | 74473 | 11/1927 |
| JP | 58-104077 | 7/1983 |
| JP | 60-40187 | 3/1985 |
| WO | WO 98/31193 | 7/1998 |

* cited by examiner

*Primary Examiner*—Suhan Ni
(74) *Attorney, Agent, or Firm*—Oblon, Spivak, McClelland, Maier & Neustadt, P.C.

(57) ABSTRACT

An otoplasty for behind-the-ear provisions for hearing aids, with which a preferably flexible signal conductor coming from the behind-the-ear device, such as a sound tube, can be positioned in the auditory canal. The otoplasty is individually adapted to the anatomy of the patient. Its fixing part is essentially in the form of a hook that follows the outer edge of the patient's cavum conchae in an arch, at least in some areas. A limb that follows the edge of the cavum conchae becomes a bent transversal section above the patient's antitragus, traversing the cavum conchae, extending in the direction of the patient's porus acusticus externus and expanding at its end section which comes to rest in the upper area of the auditory canal, to receive the signal conductor.

10 Claims, 13 Drawing Sheets

OTOPLASTY FOR BEHIND-THE-EAR (BTE) HEARING AIDS

Figure 1:
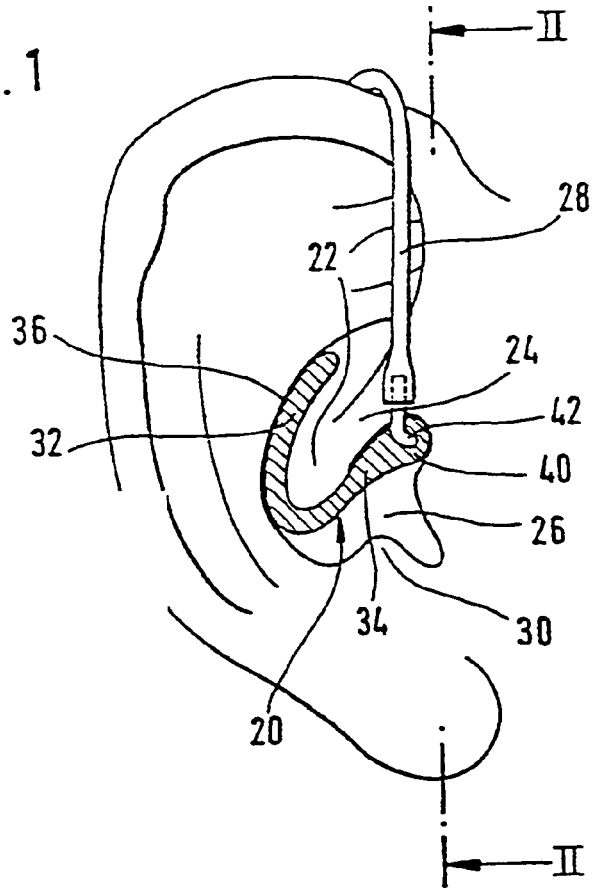

The invention relates to an ear fitting piece, i.e. an earpiece for behind-the-ear (BTE) devices in the field of hearing acoustics. These devices are also frequently referred to as BTE-secret ears (SE). In this connection, in comparison with SE solutions, which use an external hearing aid with additional equipment hidden in the clothing, a relatively short sound tube, individually adapted to the anatomy, is used, making it possible to noticeably reduce friction losses, particularly in the high-frequency sonic range.

However, the sound tube must be precisely positioned in or on the auditory canal, and for this purpose, an ear fitting piece, i.e. an earpiece is regularly used, which is individually adapted to the human anatomy of the ear of the patient to be treated. Up to the present date, various forms of earpieces have become common, with some, namely the so-called "open" BTE earpieces, being particularly preferred, in order to have the minimum possible effect on the auditory canal, caused by partially covering or closing it off in some regions, with a "foreign body." These "open" BTE devices have the further advantage that the hearing capacity that still exists is impaired as little as possible in terms of its natural effect.

Known relevant earpieces are known as "SE shell shape, SE clip shape, or SE claw shape" (See Ulrich Voogdt: Otoplastik—Die individuelle Otoplastik zur Höbrgeräte-Versorgung . . . [Earpieces—Individual earpieces for hearing aids . . . ], Volume 2 of the scientific series "Akademie für Hörgeräte-Akustik" [Academy for hearing device acoustics], Median-Verlag of Killisch-Horn GmbH, 1993). A modified version of these common earpieces is the "open" solution. However, all of the variants have the common feature that it is frequently not possible to make the hearing correction as natural as possible.

It is therefore the task of the invention to create an earpiece for "open" BTE hearing aids, for CI components (cochlear implant microphone systems and CI BTE processors), or BTE tinnitus systems, which are characterized not only by a minimal feeling of wearing a foreign body, and good wearing comfort, but primarily in that natural sound processing in the human ear can be utilized with as little distortion as possible, in order to ensure a maximum degree of hearing correction and sense of natural hearing.

This task is accomplished by an earpiece according to present invention and/or according to present invention.

With the earpiece according to the invention, in accordance with present invention, it is possible to keep the auditory canal open at the decisive points, to a degree that has not been achieved until now. The invention is based on the consideration that the sense of natural hearing, on the one hand, and the effectiveness of the hearing correction, on the other hand, are significantly influenced by the anatomically determined, natural resonance conditions in the auditory canal, including the external ear. Using the structure of the earpiece according to the invention, the natural resonance remains largely unaffected, even if the auditory canal is very narrow. In this connection, there are the additional advantages that the wearing comfort is extremely good (material-free region in the region of the crus helicis; no accumulation of heat), that the earpiece requires very little material and therefore also has cosmetic advantages, and that acoustic coupling for influencing the frequency and the dynamics can take place more free of complications. In this connection, there is the additional advantage that a material-free region is formed around the crus helicis, which has a positive effect on wearing comfort, because no redness or pressure lesions occur in this sensitive area. Furthermore, it has been shown that in the upper entrance region to the auditory canal, a better fit can be achieved than with a conventional sound tube or CROS holders.

Although the earpiece according to the invention takes up less room, it can reliably fulfill the function of stabilizing the sound tube, in that the coupling between the sound tube and the BTE device is utilized for stabilization.

It has been shown that the support elements of the earpiece are positioned in such a stable manner, in spite of the reduced contact area with the cavum conchae, that the end segment of the earpiece traverse part can carry an auditory canal tab, in accordance with the further development in present invention, making it possible to achieve better support in the auditory canal. In this connection, the auditory canal tab can easily be positioned in the upper region of the auditory canal, without touching.

An advantageous further development is the object of present invention. Here, the clip becomes an ⁞⁞E⁞⁞, similar to a ⁞⁞Euro-E ⁞⁞, which makes it possible to achieve better support for some anatomies.

The task stated above is accomplished in accordance with a second alternative in accordance with present invention, in that the earpiece is, for the first time, positioned at a location of the external ear that lies entirely outside of the cavum conchae. It has surprisingly been shown that when positioning the part of the earpiece that provides the hold in the cymba, it is easily possible, in interaction with the inherent stability of the flexible signal conductor or the sound tube, to precisely and reproducibly position the latter in the auditory canal, which is no longer blocked off by an earpiece component, according to the invention. In this way, this earpiece is particularly well suited, in addition to "open" standard applications, for applications in children with deafness in one ear, or, for example, for students with normal hearing but with a so-called reading/spelling weakness, in connection with so-called FM (frequency modulation) systems in which the teacher's speaking signal is fed into the auditory canal of the hearing-challenged child via a microphone and a microport system. Particularly in this case, utilization of the natural auditory canal resonance is very important, and this is achieved by the earpiece according to the invention, to a degree that has not been achieved until now. Because of the improved general conditions, it is furthermore easier to undertake acoustical coupling of the hearing device to the frequency and dynamics influencing system, so that the earpiece according to the invention is also well suited for use in media, e.g. during live television interviews, as a type of "in-ear monitoring," where in this case, a simultaneous translation, for example, or the voice signal of a prompter, are fed into the auditory canal under the most natural conditions possible. Another area of application of the earpiece according to the invention is in future radio communications systems (personal communication devices).

A particular advantage of the earpiece according to present invention can be seen in that there is great freedom with regard to the structure of the clip that goes around the external ear in the shape of an arc, which in turn can be utilized for additional stabilization of the earpiece.

The further development according to present invention goes in this direction.

If the main body of the earpiece that provides the hold is extended into the region of the crus anthelicis, according to present invention, stabilization of the main body is further improved, which makes it possible to further reduce the size of the main body. At the same time, this improves the wearing comfort, and it also has advantages in terms of cosmetics.

In BTE systems, a so-called continuous standard tube or ⁞Libby horn⁞ serves as an acoustical feed line of the sound given off by the hearing device, in order to avoid impedance jumps in the acoustical feed line. As a rule, this tube is surrounded by a plastic on the auditory canal end, and provided with a holder or support, for example in the form of a ring, hoop, clip or claw part. Even if the conventional earpiece is adapted to the shape of the external ear or of the auditory canal of the wearer, it can provoke a more or less disruptive feeling of being worn, and the so-called closure effect (occlusion), in spite of additional bores of different sizes. Using the structure according to the invention, these problems are effectively countered, and at the same time, the acoustical functions, such as acoustical coupling for influencing frequency and dynamics, are optimally fulfilled.

The individual anatomic conditions that exist from one case to another are additionally taken into account with the further developments of present invention.

With the further development according to present invention, the sound tube eye is displaced a little bit downward, so that the clip that goes over the edge of the external ear runs downward at a slant, in order to be able to better stabilize the sound tube in the vicinity of the entrance to the auditory canal.

Even more effective stabilization of the sound tube results from the further developments according to present invention.

The further development according to present invention is the most ambitious variant cosmetically.

The embodiments according to present invention, just like the embodiment according to the embodiment described above, have the advantage that they can be used without complications for specific special applications, such as a very narrow auditory canal or a lot of hair at the end of the auditory canal, or other anomalies of the ear anatomy.

Further developments of the invention are the object of the other dependent claims.

Figure 2:
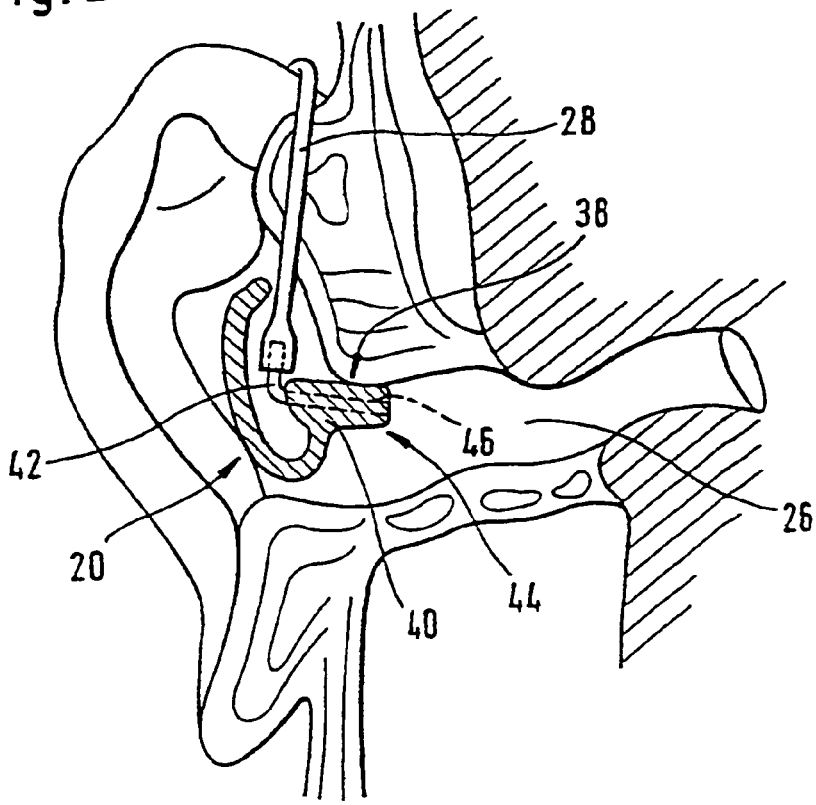
Figure 3:
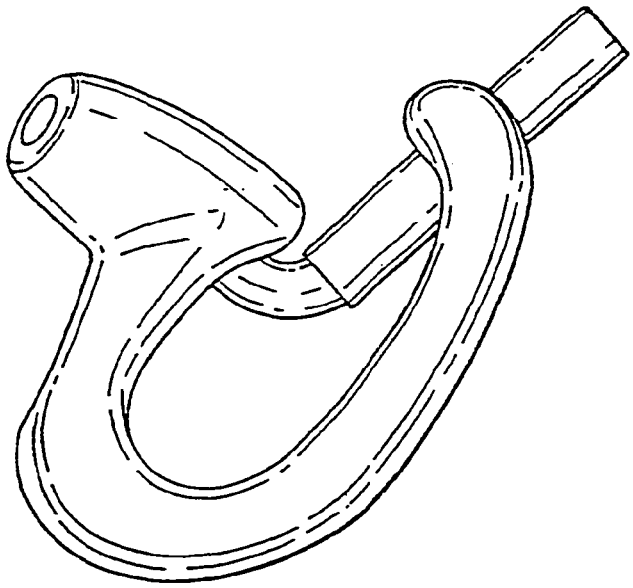
Figure 4:
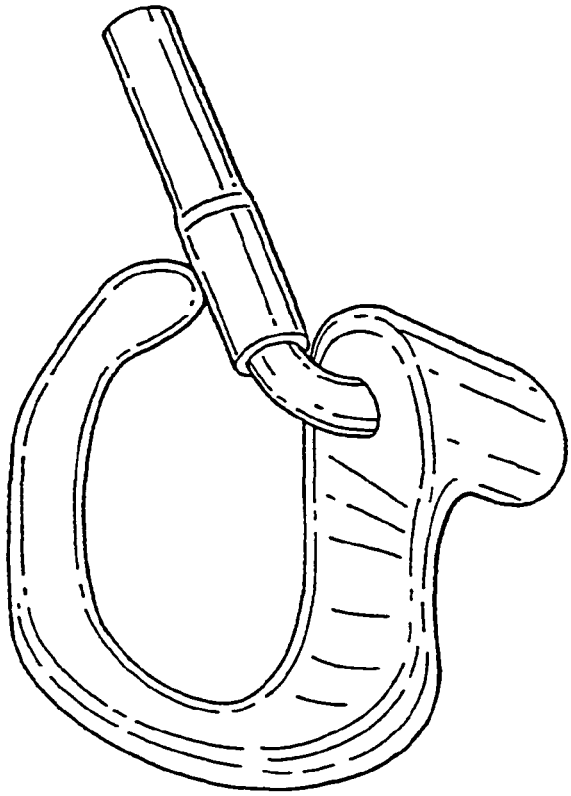
Figure 5:
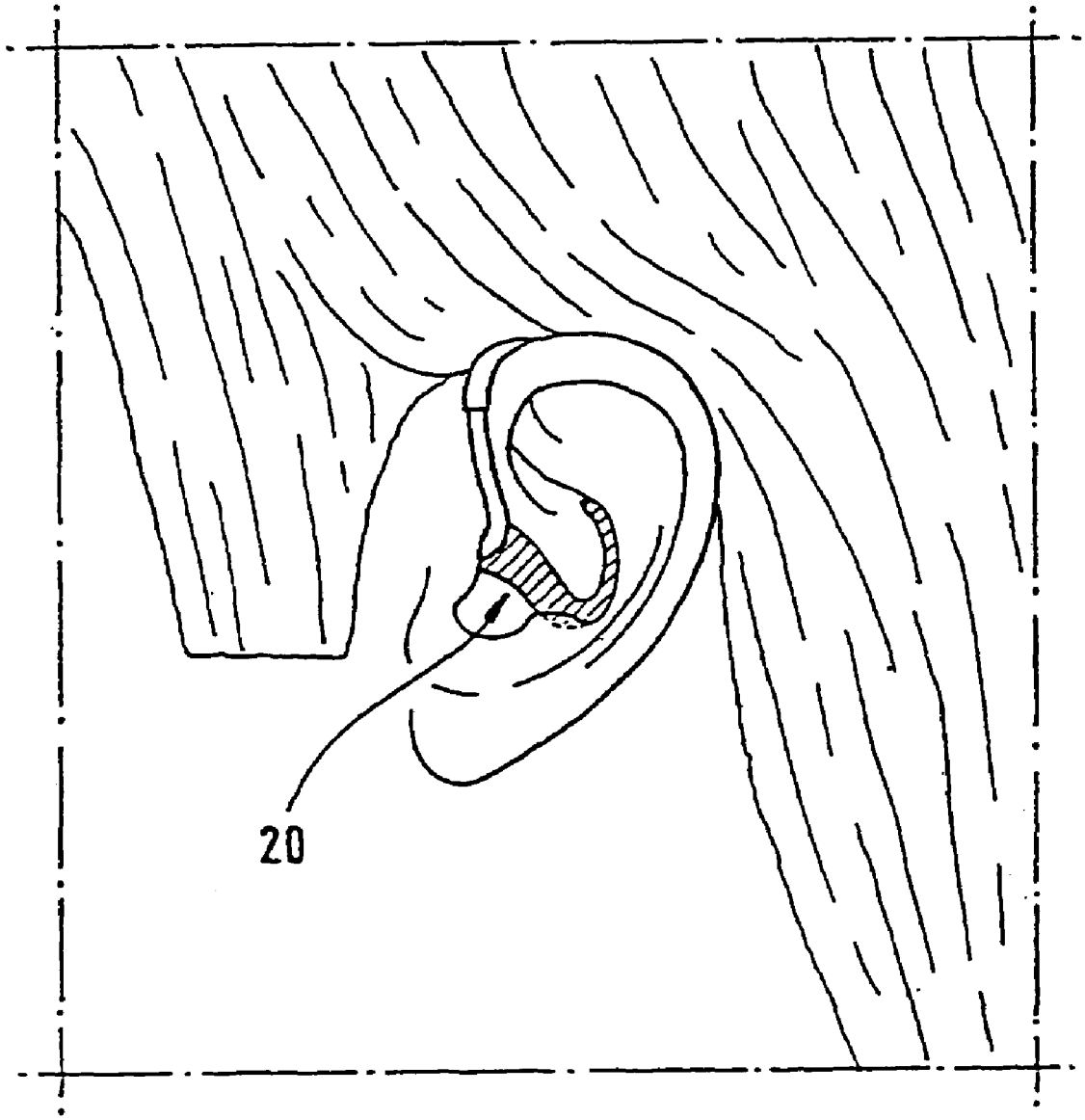
Figure 6:
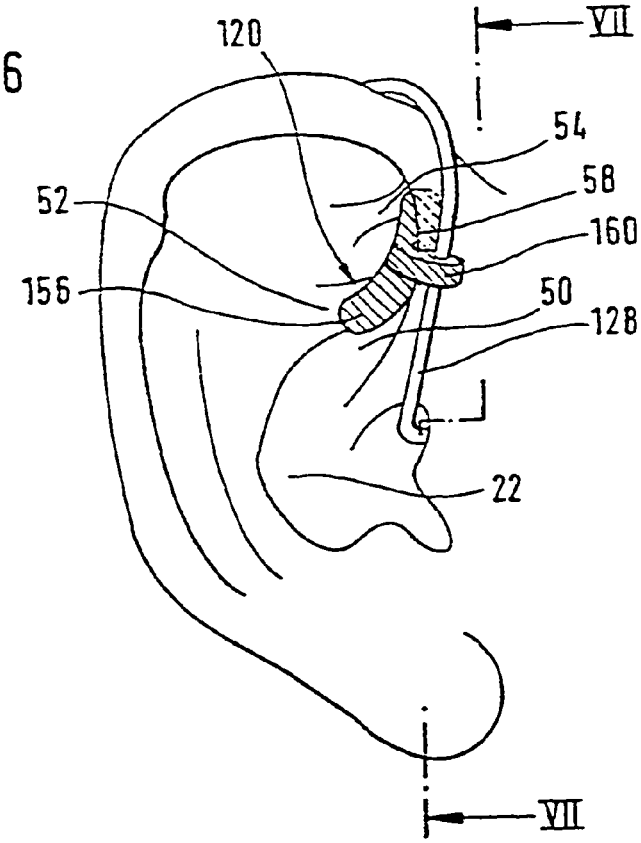
Figure 7:
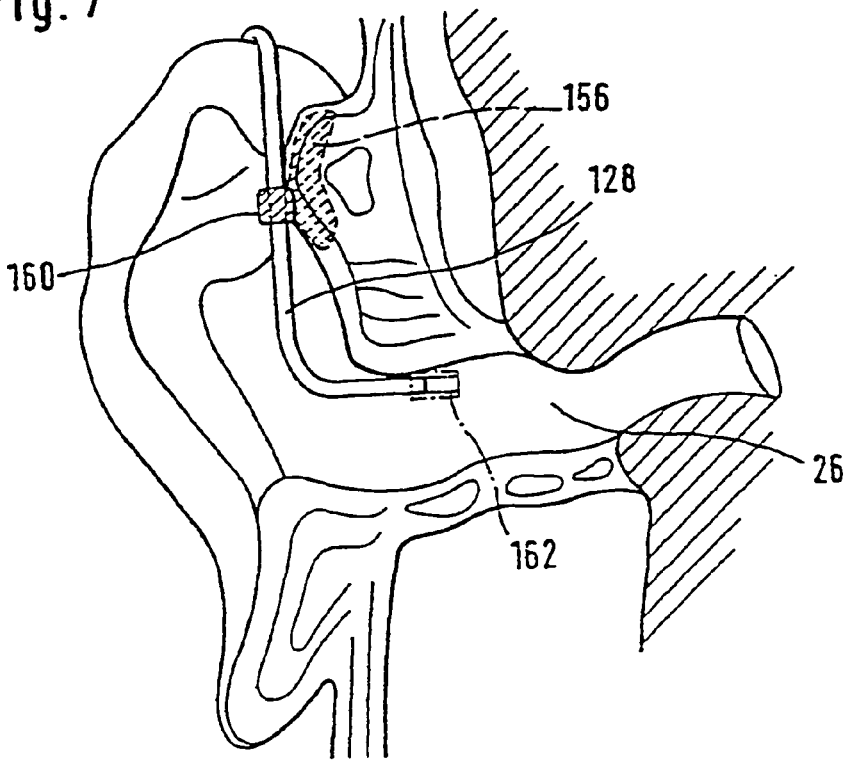
Figure 8:
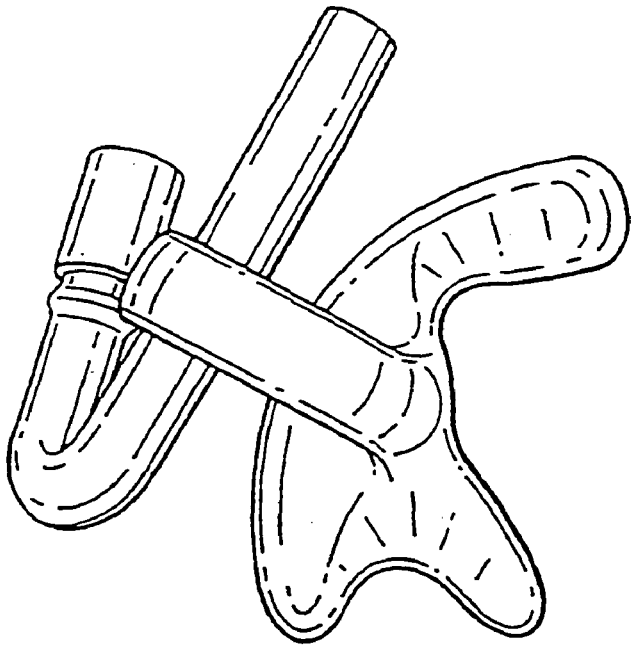
Figure 9:
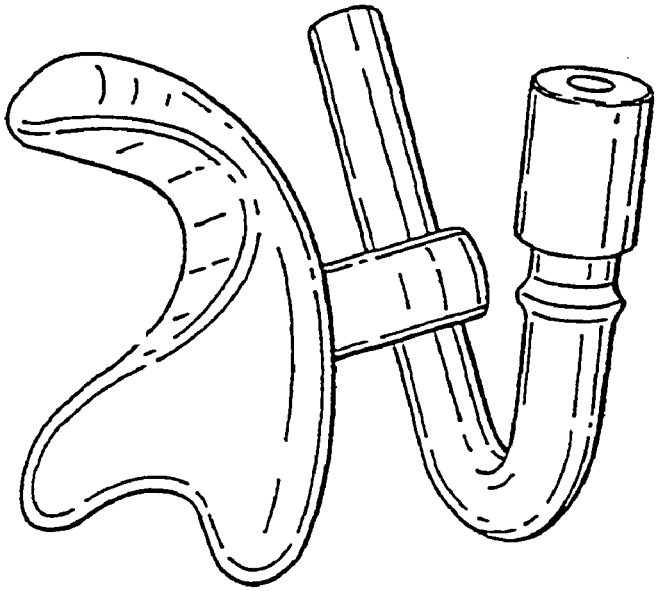
Figure 10:
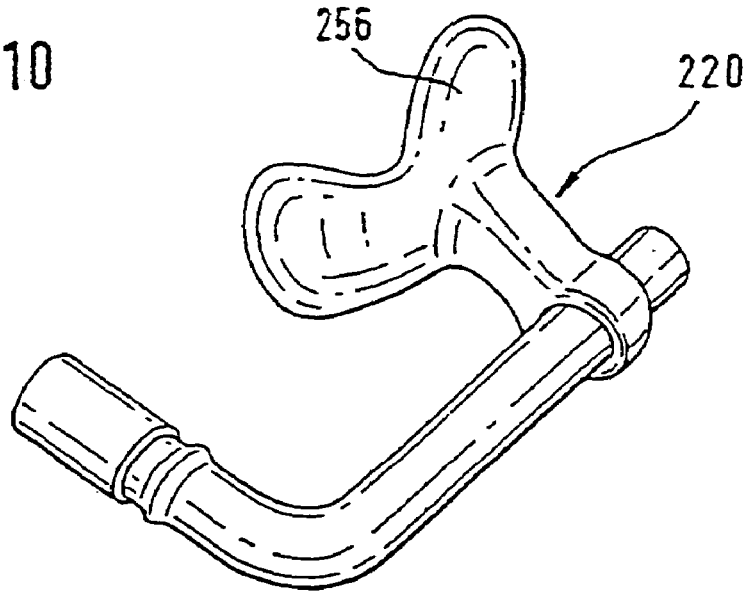
Figure 11:
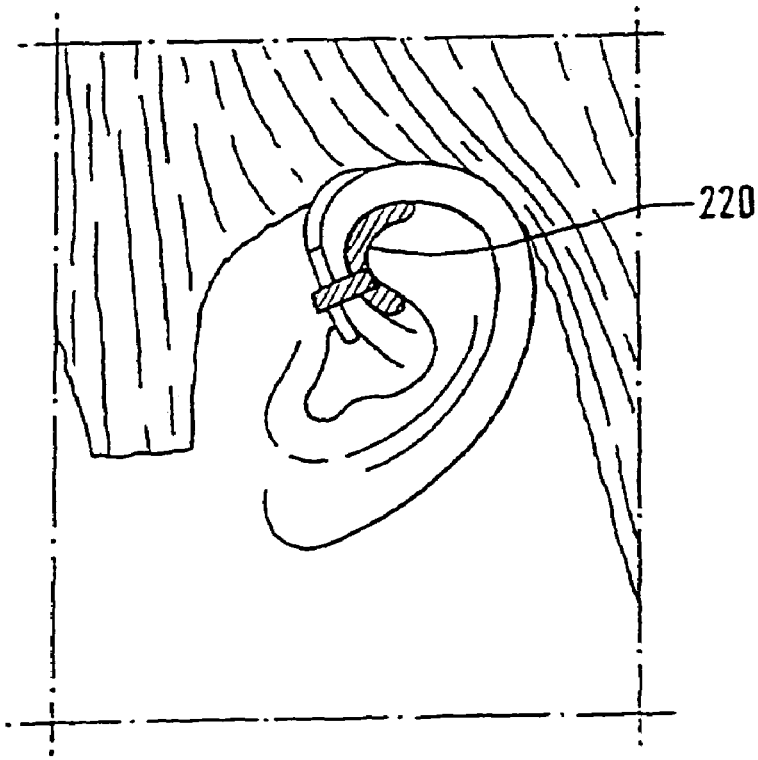
Figure 12:
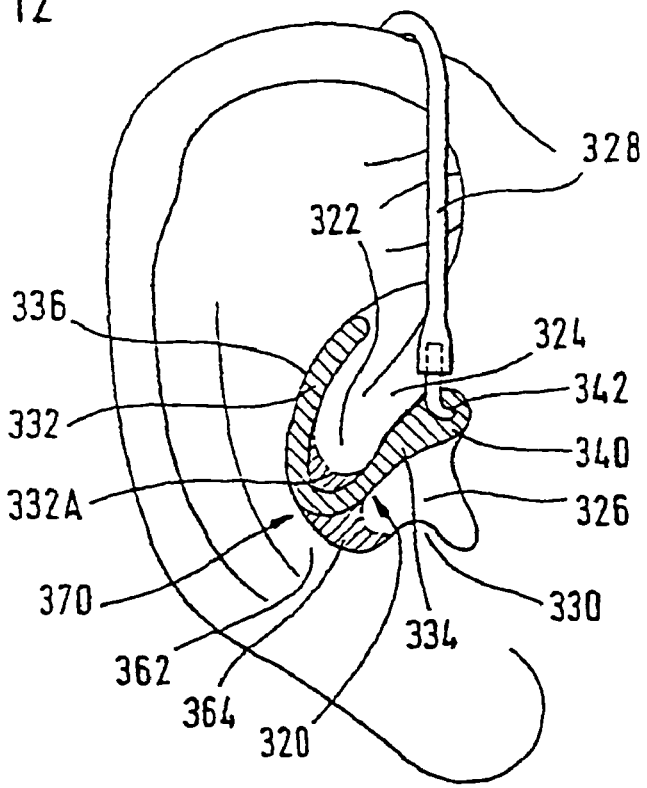
Figure 13:
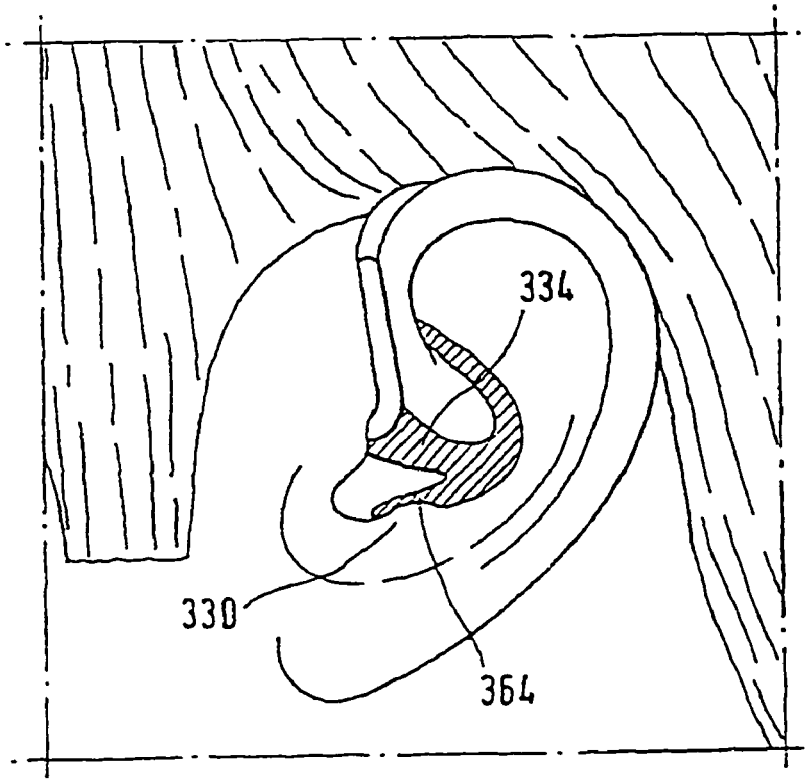
Figure 14:
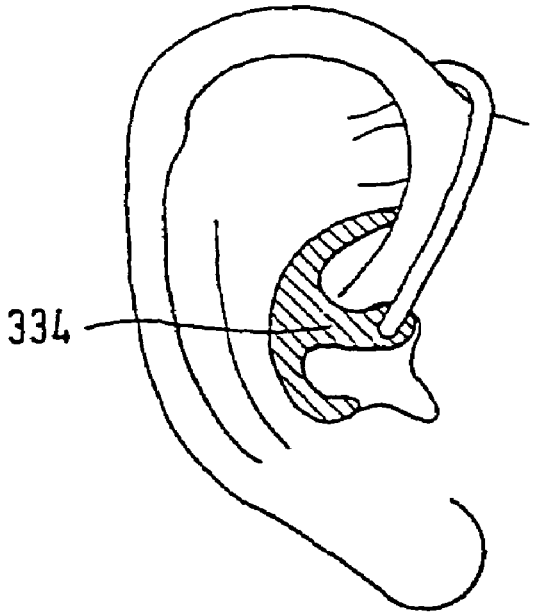
Figure 15:
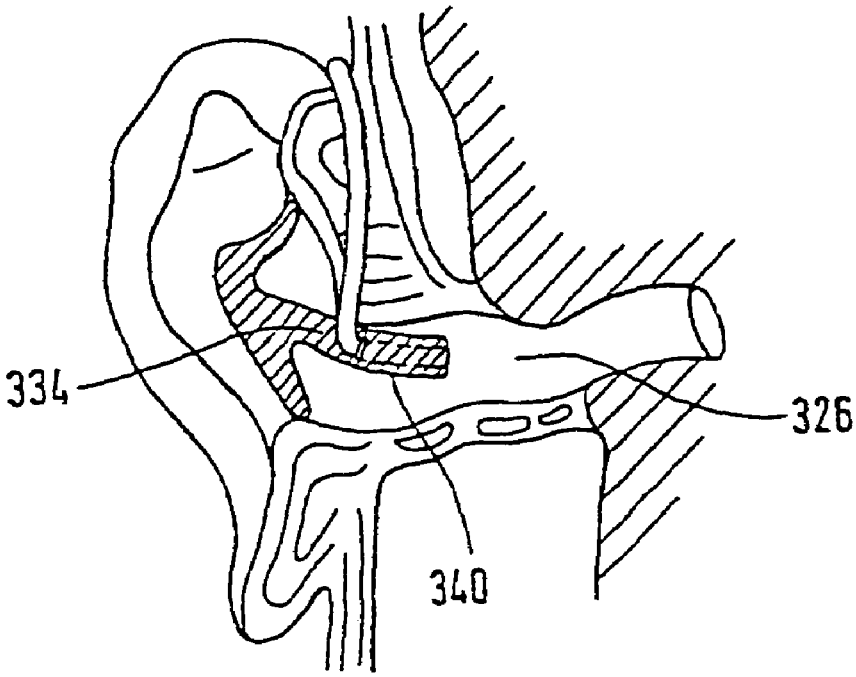
Figure 16:
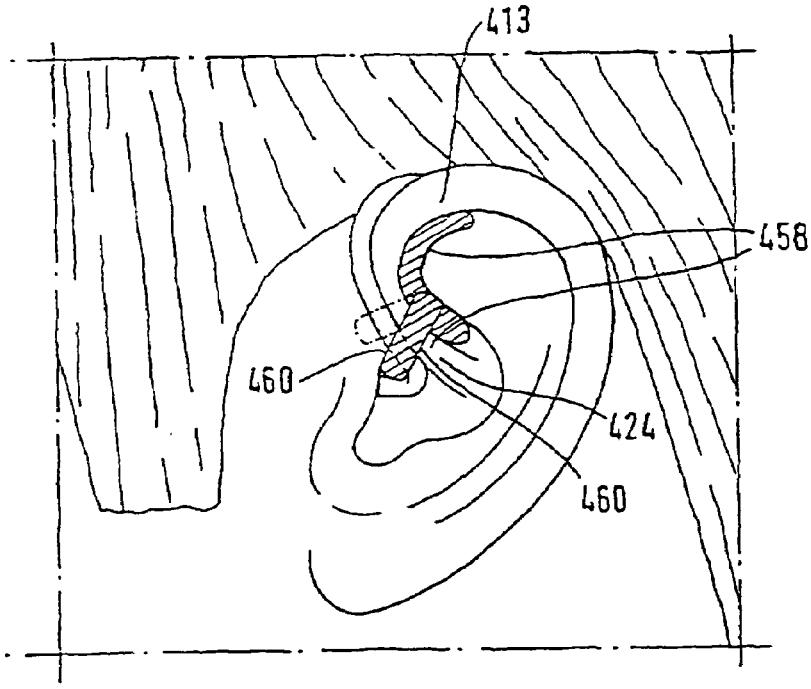
Figure 17:
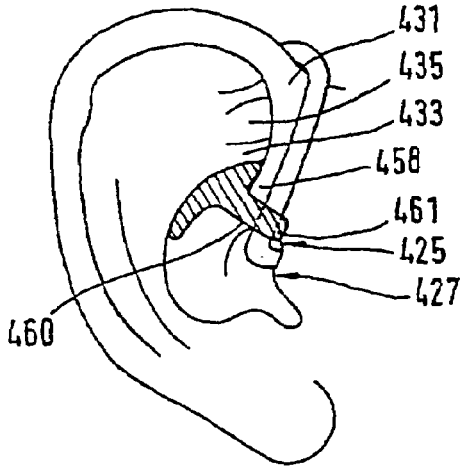
Figure 18:
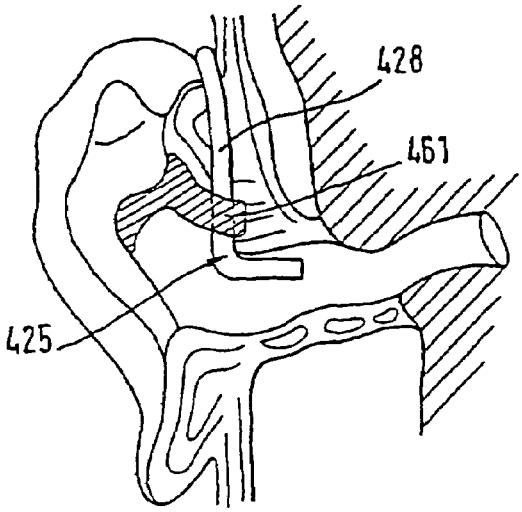
Figure 19:
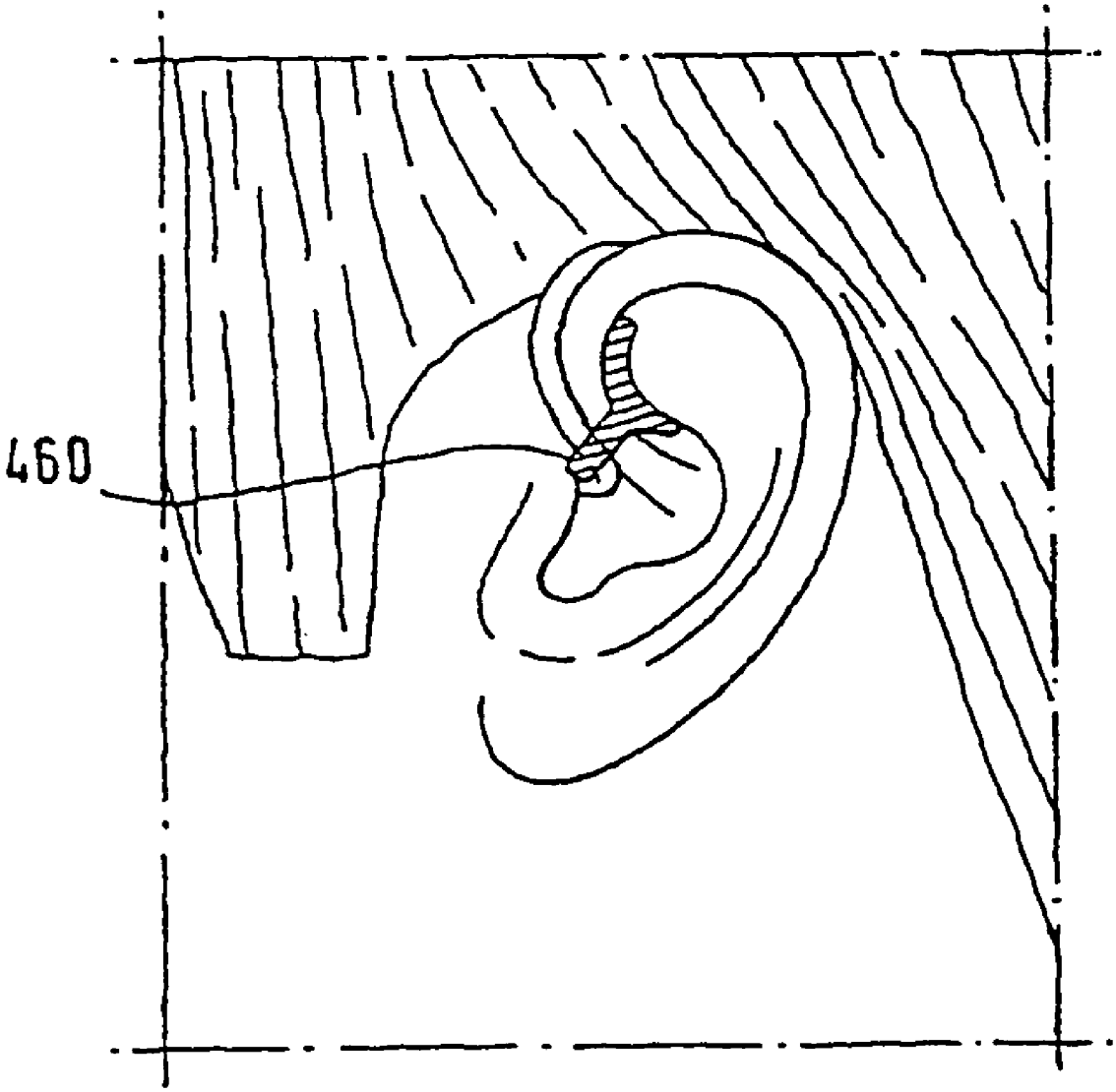
Figure 20:
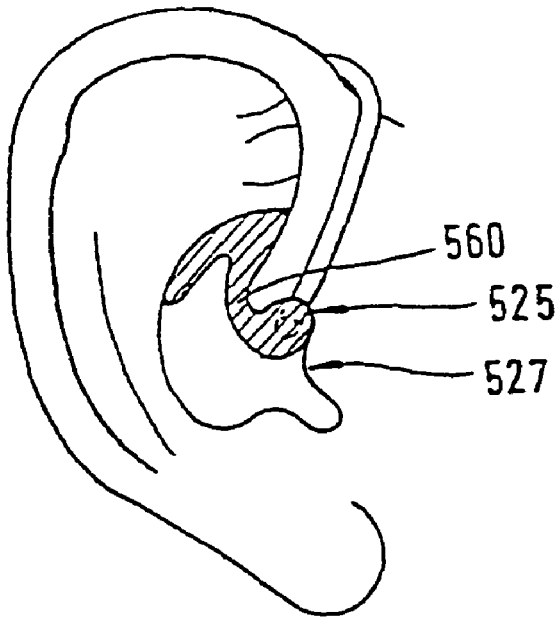
Figure 21:
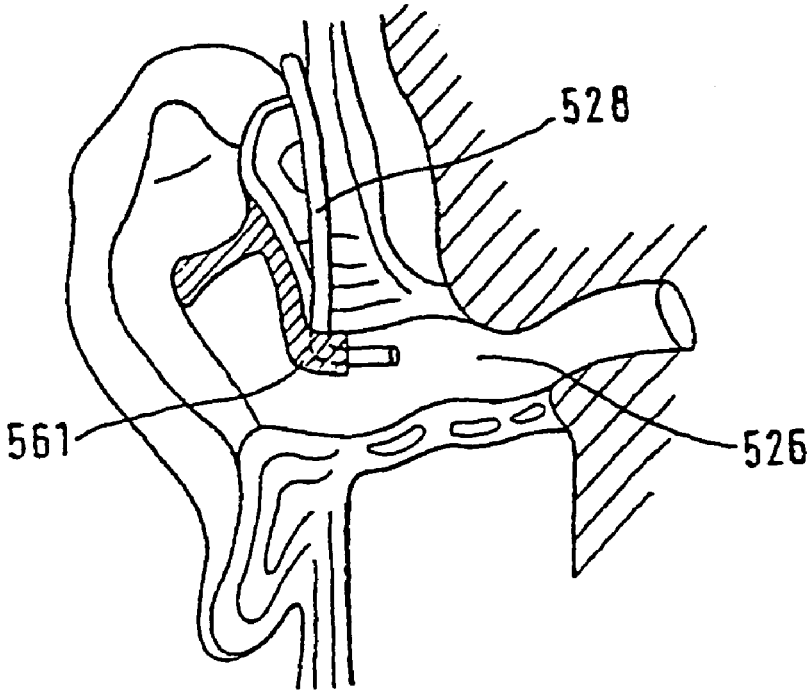
Figure 22:
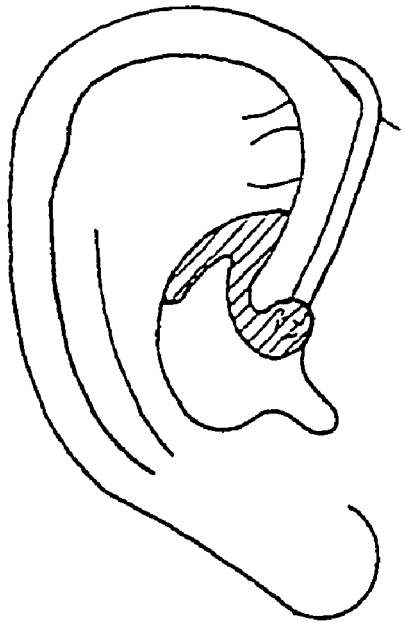
Figure 23:
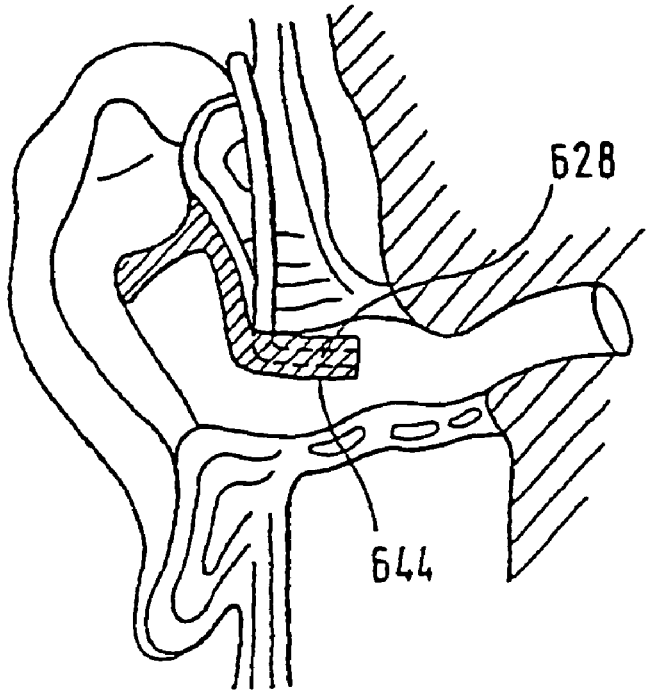
Figure 24:
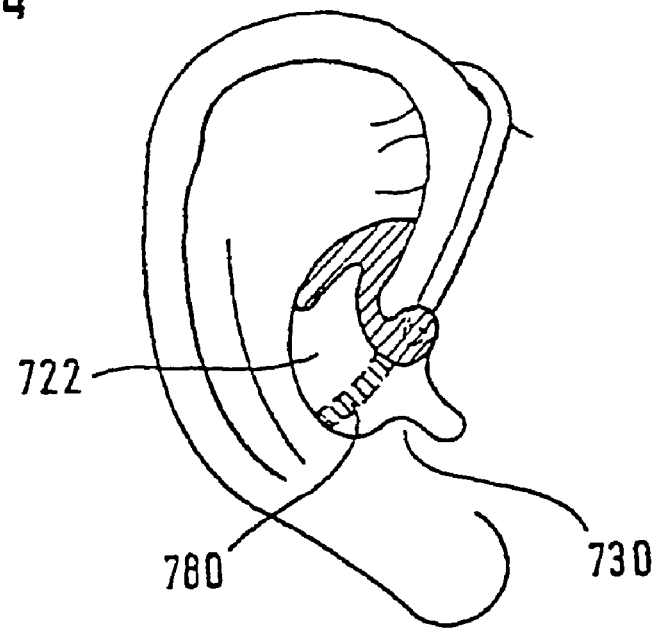
Figure 25:
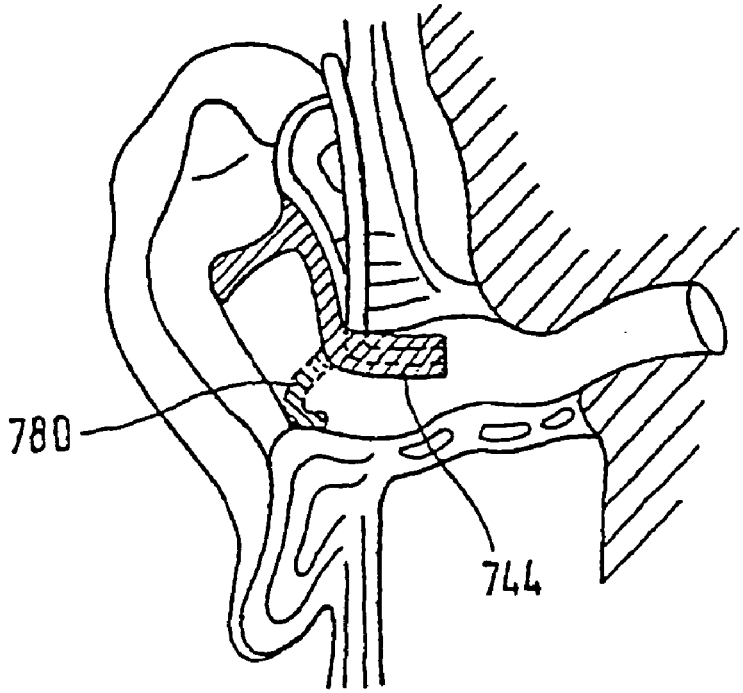

In the following, exemplary embodiments of the invention will be explained in greater detail, using the schematic drawings. These show:

FIG. 1: a view of an ear from the side, with the earpiece according to the first embodiment inserted in it;

FIG. 2: cross-section II-II in FIG. 1;

FIG. 3, FIG. 4: on a larger scale, representations of an actual manufactured earpiece of the embodiment according to FIG. 1, 2;

FIG. 5: a view of an earpiece placed in an external ear, according to the construction corresponding to the first embodiment;

FIG. 6: a view of an ear from the side, with the earpiece according to the second embodiment inserted in it;

FIG. 7: cross-section VII-VII in FIG. 6;

FIG. 8, FIG. 9: on a larger scale, representations of an actual manufactured earpiece of the embodiment according to FIG. 6, 7;

FIG. 10: an enlarged view of another embodiment of the earpiece, with a main body of a smaller size; and FIG. 11: a view of an earpiece according to FIG. 10, placed in an external ear;

FIG. 12: a view of a variant of the earpiece according to FIG. 1 to 5, corresponding to FIG. 1;

FIG. 13: a view of the earpiece according to FIG. 12, similar to FIG.;

FIG. 14: a view of a modification of the earpiece according to FIG. 12, corresponding to FIG. 12;

FIG. 15: a cross-sectional view of the embodiment according to FIG. 14;

FIG. 16: a view of a further development of the earpiece according to FIG. 6 to 11, corresponding to FIG. 11;

FIGS. 17 and 18: views of a first embodiment of the earpiece according to FIG. 16;

FIG. 19: a view of the earpiece according to FIG. 17 and 18, similar to FIG. 13;

FIGS. 20 and 21: views of a second embodiment of the earpiece according to FIG. 16;

FIGS. 22 and 23: views of a third embodiment of the earpiece according to FIG. 16;

FIGS. 24 and 25: views of a variant of the third embodiment of the earpiece according to FIGS. 22 and 23.

FIG. 1 shows an earpiece, with the reference number 20, for a BTE device, which is used in the cavum conchae, referred to with the reference number 22. The crus helicis is referred to with the reference number 24, and the auditory canal, i.e. the meatus acusticus externus, is referred to with the reference number 26.

The earpiece serves to stabilize a sound tube 28 that leads to the BTE device, not shown, which tube opens into the auditory canal. For this purpose, the earpiece is individually adapted to the anatomy of the patient, for example by means of an impression-taking procedure. It essentially has the shape of a clip with two shanks 32, 34. The first shank extends in arc shape along the outer edge 36 of the cavum conchae 22 up to a point above the antitragus, referred to as 30. From there, the earpiece runs at an angle, upward, via a second shank that passes through the cavum conchae, which will be referred to as the traverse segment 34 in the following. The traverse segment runs in the direction of the porus acusticus externus 38 and there widens to an end segment 40, which serves to hold the signal conductor, in the case shown here, a sound tube angle piece 42.

As is evident from FIG. 2, the end segment 40 makes a transition into an acoustical canal tab 44 in which a bore 46 (shown with broken lines) is formed.

From the drawing, it is evident that the earpiece covers the auditory canal 26 only slightly, so that the natural auditory canal/external ear resonance is maintained. Additional stabilization of the earpiece 20 is achieved with the sound tube 28, which is rigidly connected with the angle piece 42.

In FIGS. 3 and 4, which show an earpiece according to FIGS. 1 and 2, made of plastic, the filigree structure is clearly evident, but nevertheless the earpiece can be fixed in place in the cavum conchae, in stable manner.

The cosmetic aspect of the earpiece according to the invention is best evident from FIG. 5, in which the visible surface of the earpiece 20 is shown with hatched lines. It is obvious that the design according to the invention is such that it has practically no detrimental effect on the natural appearance of the external ear.

FIGS. 6 to 11 show additional embodiments of the earpiece according to present invention.

The earpiece, which again is emphasized with hatched lines, as also in FIGS. 1 and 2, is referred to with the reference number 120. It is arranged in such a way that the cavum conchae remains entirely free. Instead, the earpiece is arranged in the region of the cymba conchae 50, and, in the case shown, with an extension into the region of the crus anthelicis 52, 54.

Again, the earpiece is individually adapted to the anatomy of the patient, and consists essentially of two components, namely the part 156 that provides the hold, which is shaped to fit into the cymba conchae 50, and a hill 160, which forms the holder for the flexible sound tube 128 at its end. The sound tube 128 is inserted at an angle into the interior of the auditory canal 26, as shown in FIG. 7, and can have a so-called cerum defender 162 there, for example.

This embodiment of the earpiece has an even smaller structural volume than the earpiece according to FIGS. 1 to 5, and, as is evident from FIG. 7, it has almost no influence on the auditory canal.

FIGS. 8 and 9 show an earpiece used in practical situations, on a larger scale. The surface structure of the main body, with its multiple curves, is clearly evident; this is responsible for the accurate fit and secure seat in the cymba conchae, which prevents it from being moved. The embodiment according to FIGS. 8, 9 was produced for a patient with a rather large-volume cymba conchae.

FIGS. 10 and 11 show another embodiment that was used for a patient with a significantly smaller cymba conchae. The earpiece, designated as 220, has a significantly smaller main body 256, which again is spatially curved in many places, so that the necessary undercut with the surface of the ear comes about.

From the view according to FIG. 11, it is evident that the visible part of the earpiece 220 is kept to a minimum.

Of course, all the usual materials can be used for the earpieces according to the invention, such as hot-polymerized and cold-polymerized PMMA or photopolymerizate. Because of the low volume of the earpiece, colored designs, possibly with jewelry-like applications, are also possible. Also, metals such as stainless steel, gold, silver, platinum, titanium (injection-molding or spin-casting process) can be used, and it is also possible to work with galvanic technology.

FIGS. 12 to 15 show a variant of the earpiece according to FIGS. 1 to 5. In order to simplify the description, those components that correspond to the components of the earpiece according to FIGS. 1 and 2 are provided with the same reference numbers, but with a ::3:: preceding them.

In contrast to the structure according to FIGS. 1 and 2, the clip of the earpiece 320 is modified in such a way that it essentially has the shape of a ::Euro-E::. The shank 332 that follows the edge of the cavum conchae 322 is extended beyond an angled location 370 for the traverse segment 334 and runs along the anthelix 362, so that it forms another shank 364 there. The hatched areas indicate that the individual shanks make a transition into each other via roundings 332A.

As a variant to FIG. 12, FIG. 13 shows that the additional shank 364 is extended to a location behind the antitragus 330.

FIGS. 14 and 15 explain the modification of the earpiece once again, using representations that correspond to the views of FIGS. 1 and 2. It is evident that also in this embodiment, the shank 334 that forms the traverse segment makes a transition to an end segment 340, which is connected in one piece with the auditory canal tab 340. The auditory canal tab 340 in turn is placed in the upper region of the auditory canal 326, without making contact.

FIG. 16 illustrates a possibility of structuring the earpiece according to FIGS. 6 to 11 with regard to anatomically optimized stabilization of the sound tube in the region of the entrance to the auditory canal. Here again, for the sake of simplifying the description, the same reference numbers are used for segments and components that have an equivalent in FIGS. 6 to 11, with a ::4:: preceding them.

It is evident that the clip 460 that goes around the edge 458 of the external ear in the shape of an arc has been pivoted downward from the position shown with a dot-dash line, so that it practically bridges the top segment of the crus helicis 424.

FIGS. 17 to 19 show a first embodiment of this modification. The reference number 461 refers to a sound tube eye that stabilizes a sound tube 428. The arrangement is designed in such a way that the sound tube eye 461 is located directly above the incisura anterior 425, i.e. between the tragus 427 and the crus helicis 424.

For the remainder, the embodiment corresponds to that according to FIG. 6 to 11, i.e. half of the earpiece body is located in the cymba, while the other half can run below the helix 431 via the crus inferior anthelicis 433 in the direction of the fossa triangularis 435. This is shown in FIG. 19, for example.

A second variant of the modified embodiment of the earpiece according to FIG. 16 is shown in FIGS. 20 and 21. Here again, for the sake of simplifying the description, the same reference numbers are used for segments and components that have an equivalent in FIGS. 17 to 19, but with a ::5:: preceding them.

Here, the arrangement is designed in such a way that a holder 561 for the sound tube 528 is recessed between the incisura anterior 525 and the tragus 527, in the entrance region to the auditory canal 526. The clip 560 runs at an even steeper angle than in the embodiment according to FIGS. 17 to 19.

Since the entrance region to the auditory canal, particularly in the first third of the auditory canal, is reduced in size with this variant of the sound tube mantling, there are corresponding shifts in the OEG resonance. In addition, it must be noted that the material coverage around the region of the crux helicis requires sensitive impression-taking or targeted work on the impression of this region.

A second embodiment of the modified version of the earpiece according to FIG. 16 is shown in FIGS. 22 and 23. Here again, to simplify the description, the same reference numbers are used for segments and components that have an equivalent in FIGS. 6 to 11, with a ::6:: preceding them here.

The difference as compared with the variant according to FIGS. 20 and 21 is that the sound tube holder is formed by an auditory canal tab 644 arranged without making contact in the upper region of the auditory canal, which holder surrounds the sound tube 628 or an angled piece of the earpiece.

Finally, FIGS. 24 and 25 show a modification of the variants of FIGS. 20 to 23, in such a way that further improvement of the stabilization of the earpiece is a result. The sound tube holder 744 is stabilized by way of a support claw 780, shown with hatched lines, which extends from the bottom of the sound tube holder 744 in the direction of the antitragus 730, molding itself against the concha 722.

The invention claimed is:

1. An earpiece for behind-the-ear parts of hearing acoustics devices, comprising:

an earpiece configured to be fitted in a patient's cymba;

a clip carried by the earpiece and arcuately shaped to pass over an edge of the patient's external ear when the earpiece is fitted in the patient's cymba; and a flexible signal conductor connectable to the behind-the-ear parts and carried by the clip, wherein an eye of the sound channel of the flexible signal conductor is arranged to be located directly above the Incisura anterior and between the Tragus and the Crus helicus, when the earpiece is fitted in the patient's cymba.

2. Earpiece according to claim 1, wherein the signal conductor is flexible and the BTE device is a sound tube.

3. Earpiece according to claim 1,wherein a main body that provides the hold extends into a region of the patient's crus anthelicis.

4. Earpiece according to claim 1, wherein the clip is broadened at the end and forms a sound tube holder.

5. Earpiece according to claim 4, wherein the sound tube holder is located directly above the patient's incisura anterior, between the patient's tragus and the patient's crus helicis.

6. Earpiece according to claim 4, wherein the sound tube holder is recessed between the patient's incisura anterior and the patient's tragus, in an entrance region to the auditory canal.

7. Earpiece according to claim 4, wherein the sound tube holder is formed by an auditory canal tab arranged without making contact in an upper region of the auditory canal, which holder surrounds a sound tube or an angled piece of the earpiece.

8. Earpiece according to claim 4, wherein the sound tube holder is stabilized by a support claw, which extends from a bottom of the sound tube holder in a direction of the patient's antitragus, molding itself against the patient's concha.

9. Earpiece according to claim 1, for use with cochlear implant microphones or CI BTE processors, with BTE tinnitus systems.

10. An earpiece for behind-the-ear parts of hearing acoustics devices, comprising:

an earpiece configured to be fitted in a patient's cymba;

a clip carried by the earpiece and arcuately shaped to pass over an edge of the patient's external ear when the earpiece is fitted in the patient's cymba; and a flexible signal conductor connectable to the behind-the-ear parts and carried by the clip, wherein an eye of the sound channel of the flexible signal conductor is disposed in the auditory canal such that the auditory canal remains open when the earpiece is fitted in the patient's cymba.

* * * * *